US006842913B1

(12) United States Patent
Song

(10) Patent No.: US 6,842,913 B1
(45) Date of Patent: Jan. 18, 2005

(54) SHIELD MOUNTING DEVICE OF HELMET

(75) Inventor: Yea-Ho Song, Yongin-si (KR)

(73) Assignee: JTECH Co., Ltd. (KR)

( * ) Notice: Subject to any disclaimer, the term of this patent is extended or adjusted under 35 U.S.C. 154(b) by 0 days.

(21) Appl. No.: 10/772,802

(22) Filed: Feb. 5, 2004

(30) Foreign Application Priority Data

Nov. 13, 2003 (KR) ..... 10-2003-0080053

(51) Int. Cl.[7] ..... A42B 1/08
(52) U.S. Cl. ..... 2/424
(58) Field of Search ..... 2/424, 425, 410, 2/10

(56) References Cited

U.S. PATENT DOCUMENTS 5,461,731 A * 10/1995 Shida ..... 2/424
6,260,213 B1 * 7/2001 Eom et al. ..... 2/424
2003/0182717 A1 * 10/2003 Choi et al. ..... 2/424

* cited by examiner

*Primary Examiner*—Rodney M. Lindsey
(74) *Attorney, Agent, or Firm*—R. Neil Sudol; Henry D. Coleman; William J. Sapone

(57) ABSTRACT

The present invention relates to a shield mounting device used when a shield adapted to protect a front side of a helmet user is assembled to a body of a helmet. A shield mounting device of a helmet comprises a base plate having a guide with a circular rim wall and fixed to a body of a helmet; a connection member forming in an inner surface of the shield and engaged to an inner surface of the guide; a locker assembled to an outer surface of the rim wall of the guide and locking and unlocking the connection member engaged to the guide; an insertion groove formed in an inner side of the rim wall of the guide; a protrusion piece formed on an outer surface of the rim wall; and an engaging piece formed in an outer surface of the connection member and inserted into the insertion groove.

8 Claims, 11 Drawing Sheets

【Fig. 1】
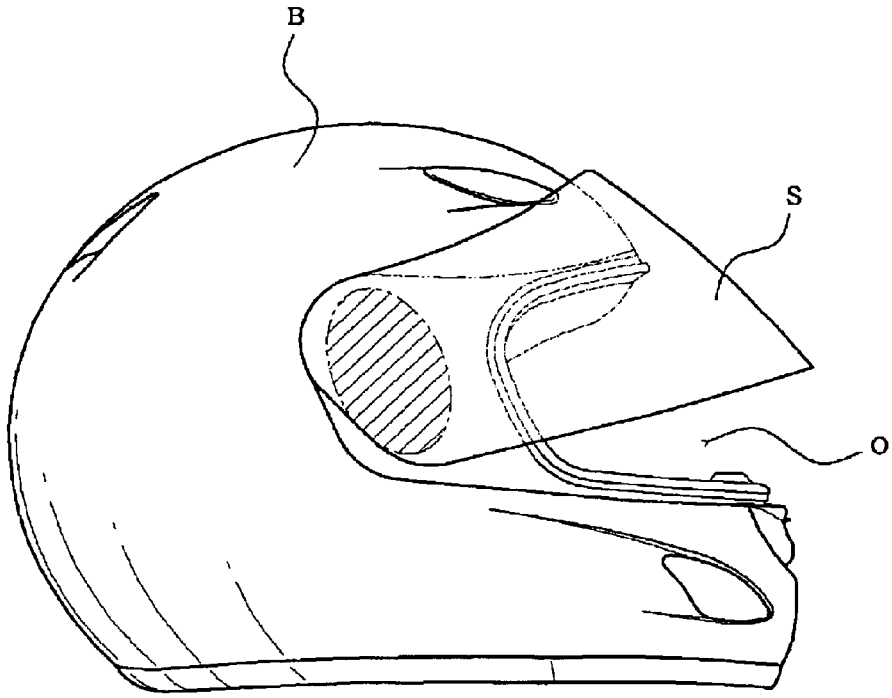

【Fig. 2】
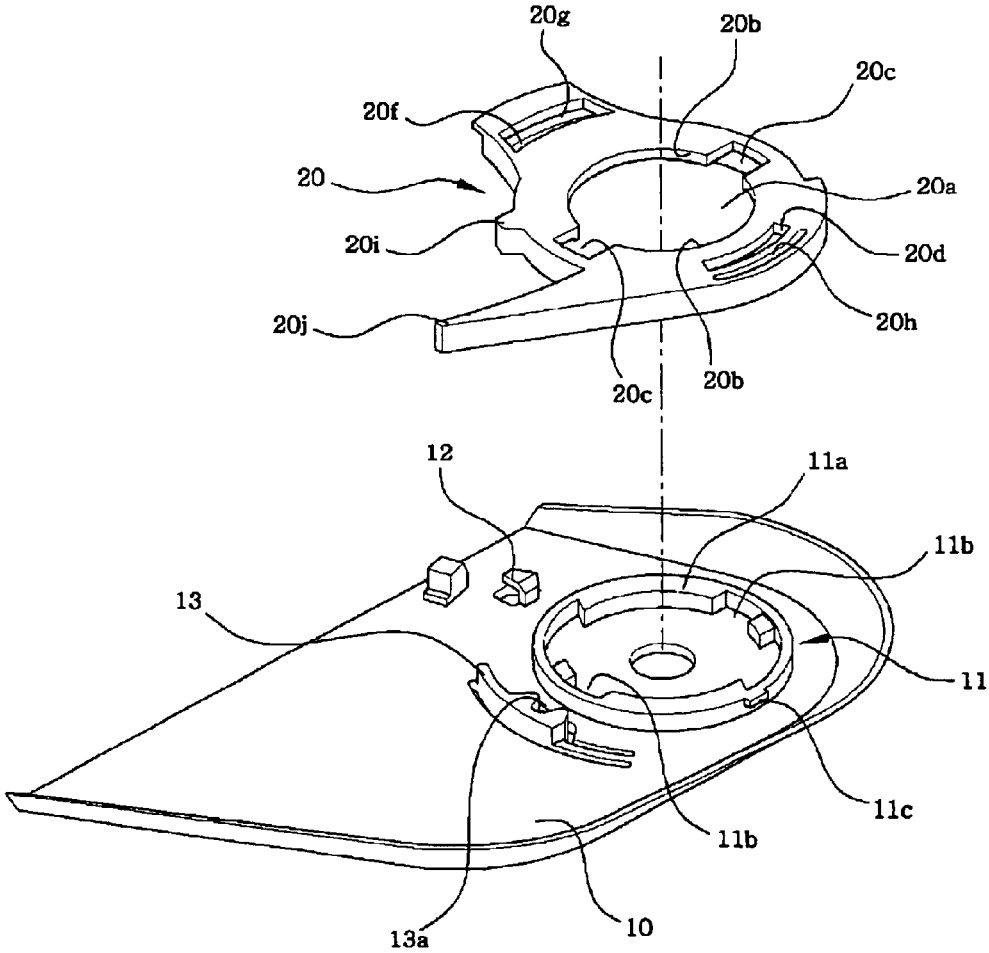

【Fig. 3】
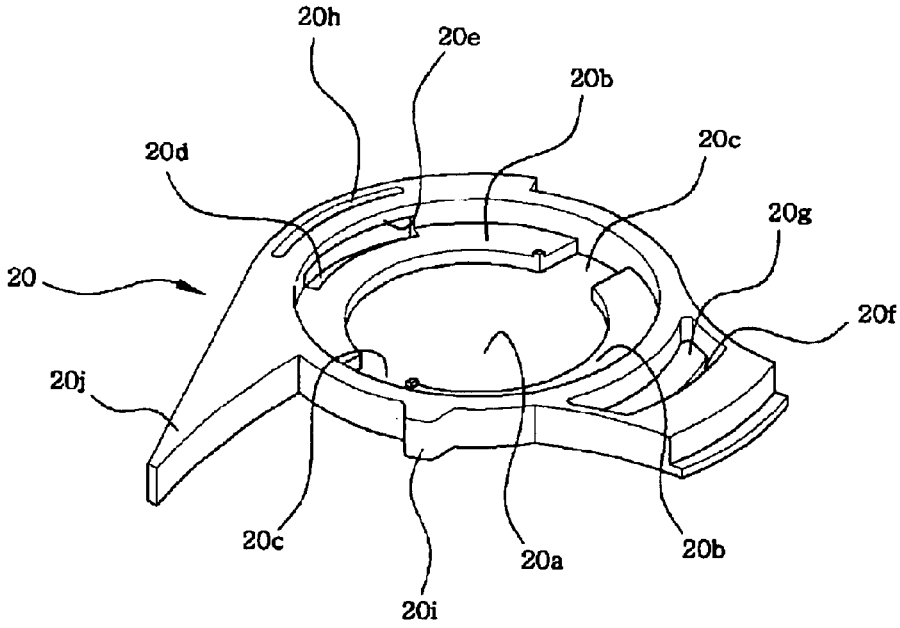

【Fig. 4】
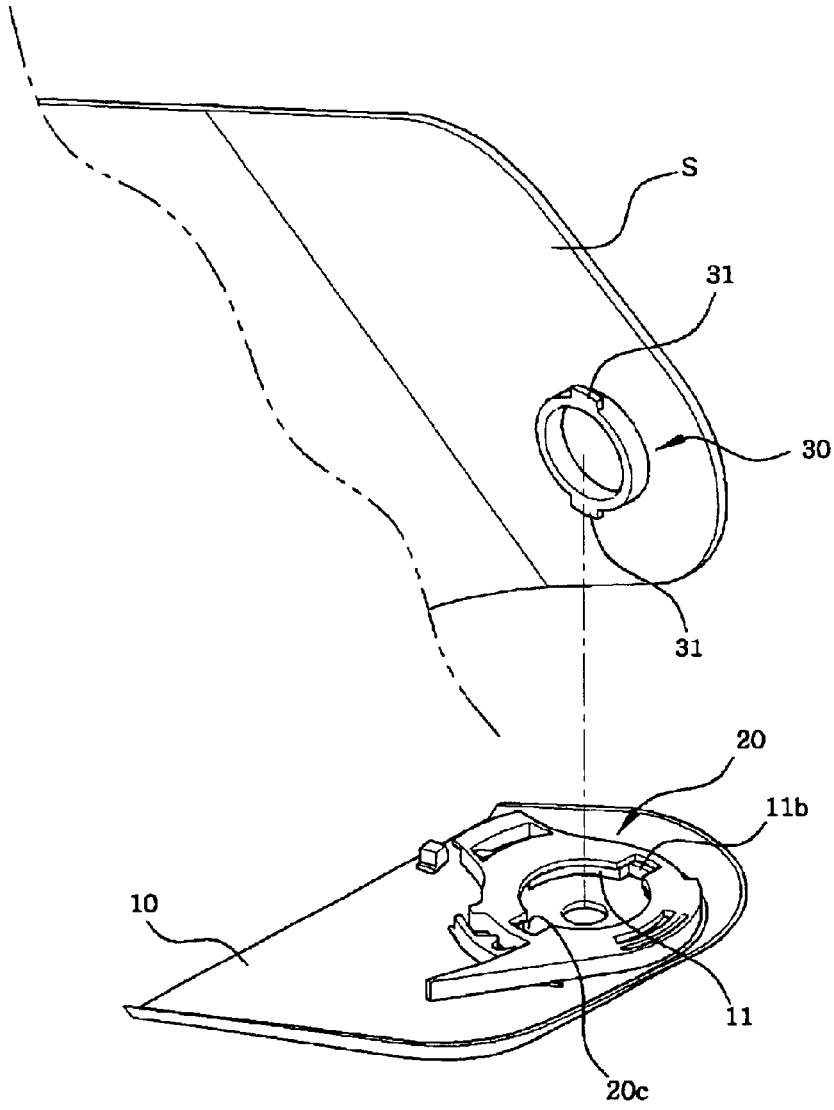

【Fig. 5】
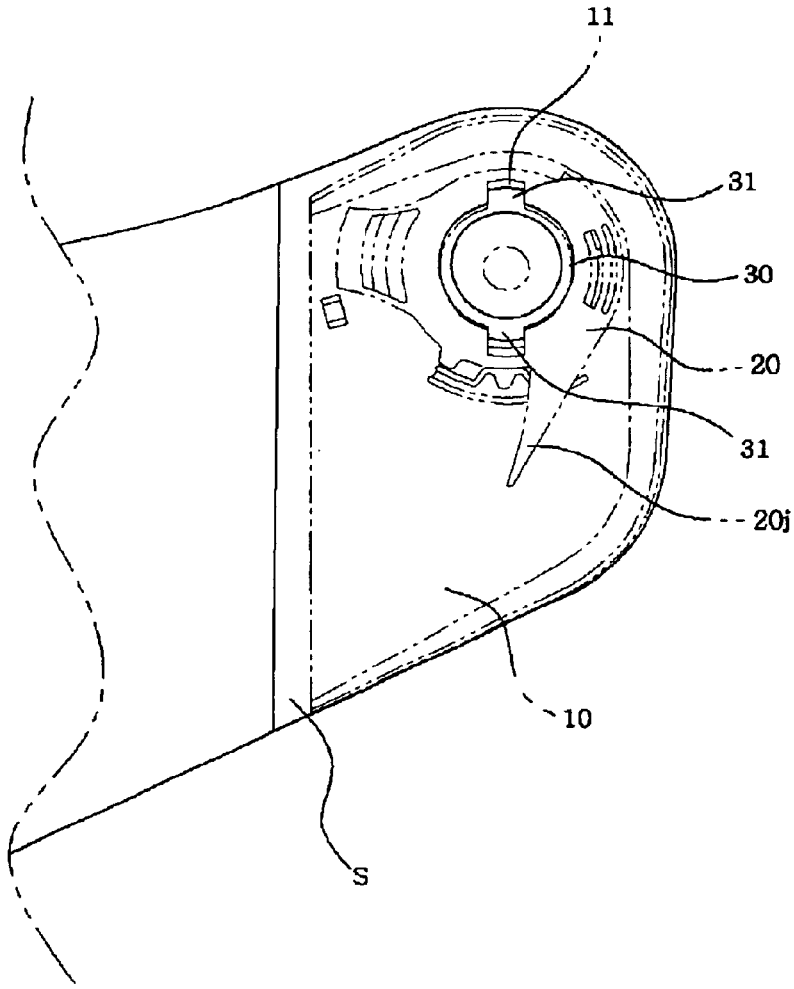

【Fig. 6】
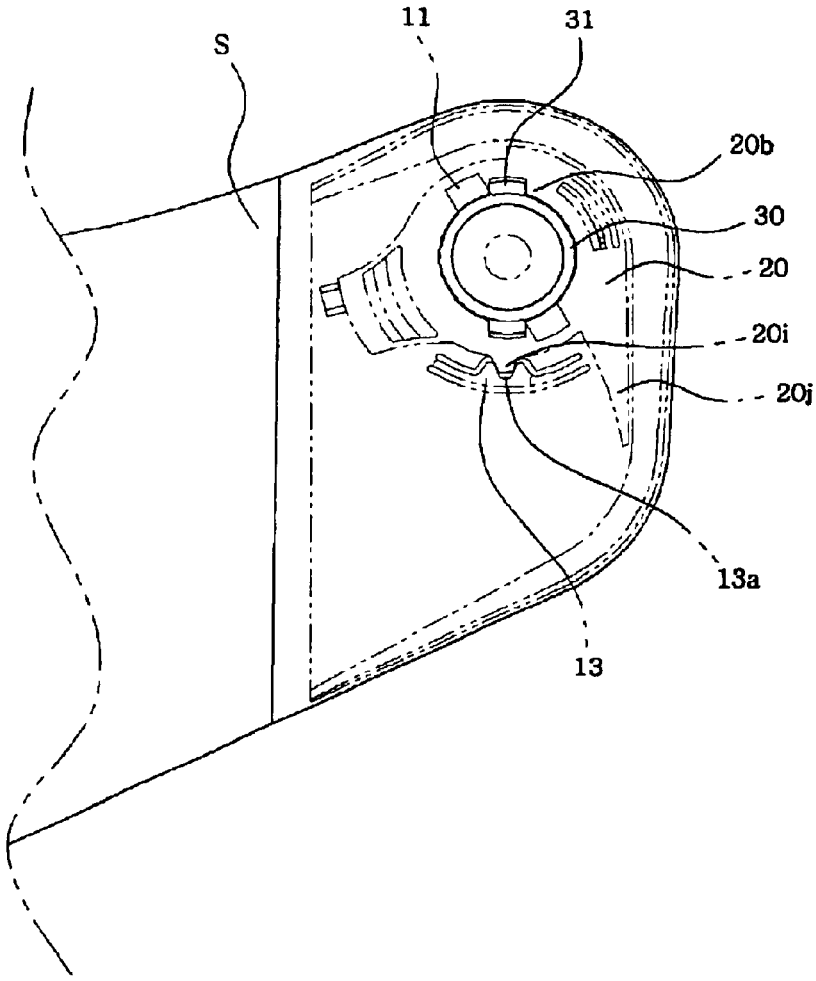

【Fig. 7】
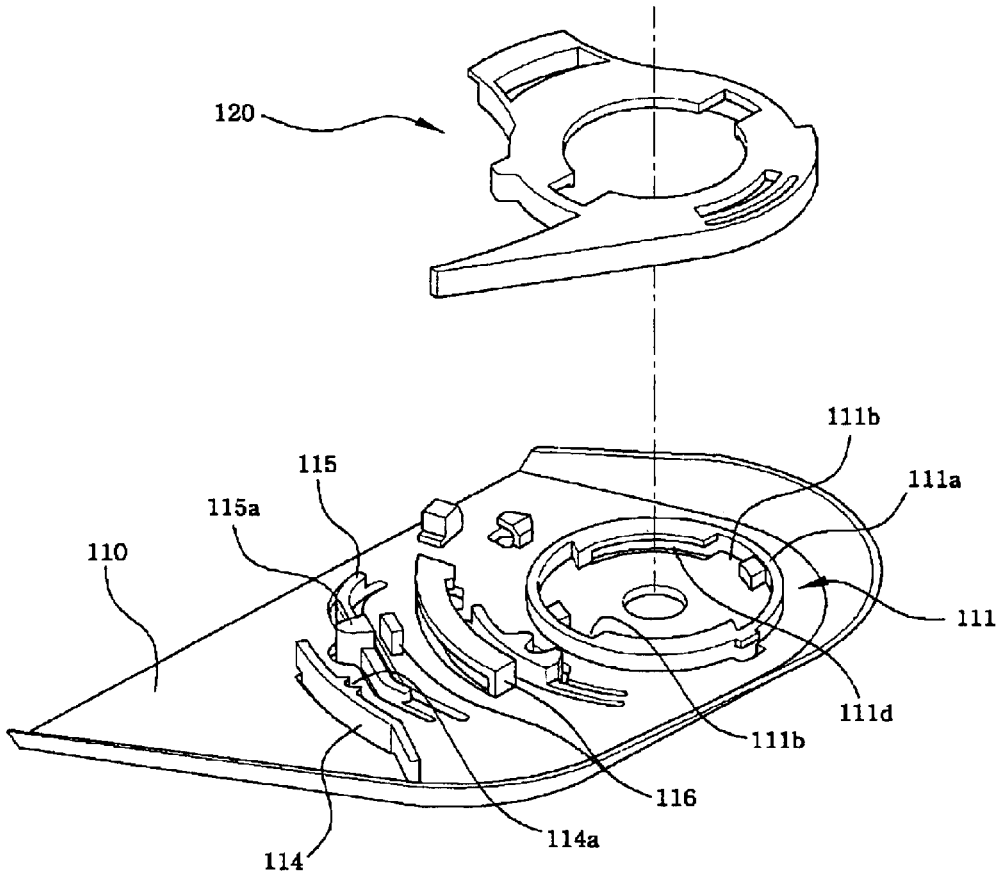

【Fig. 8】
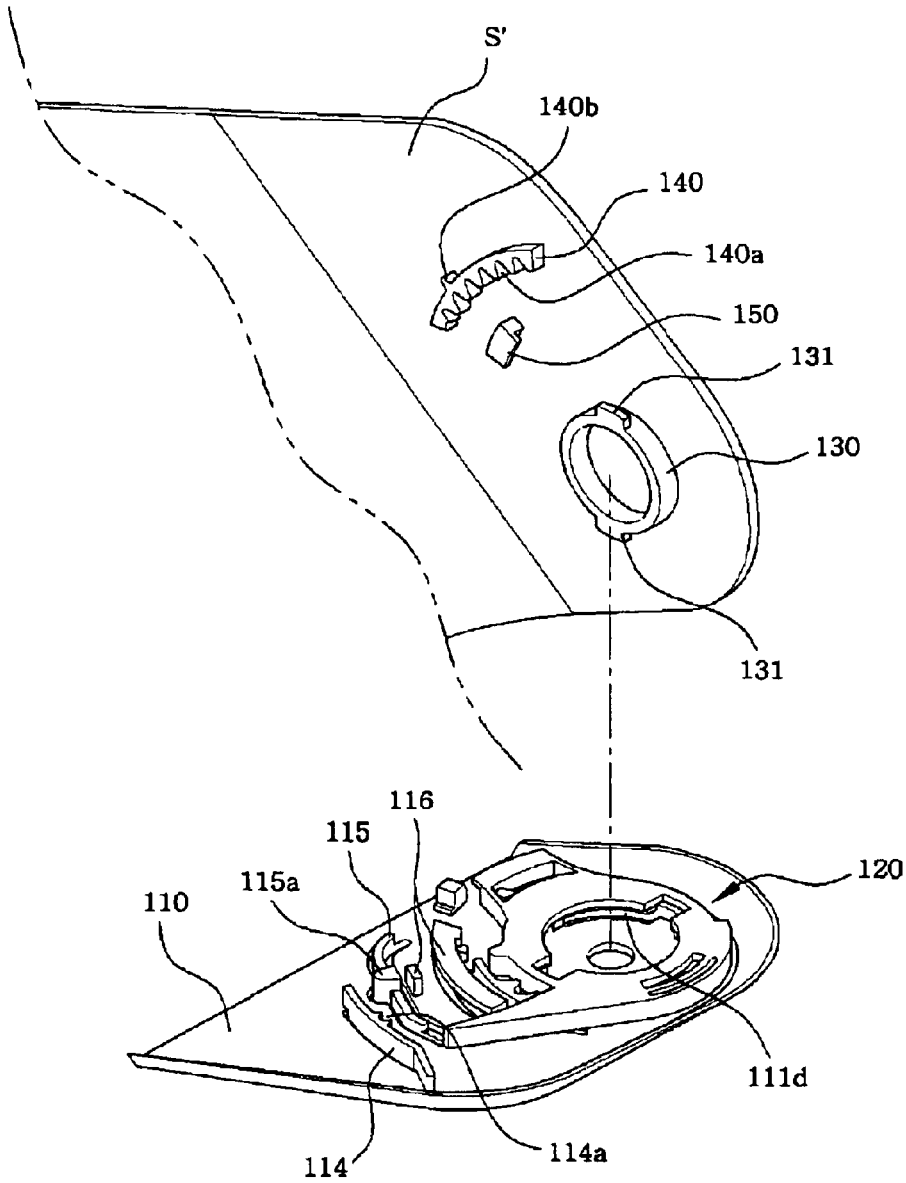

【Fig. 9】
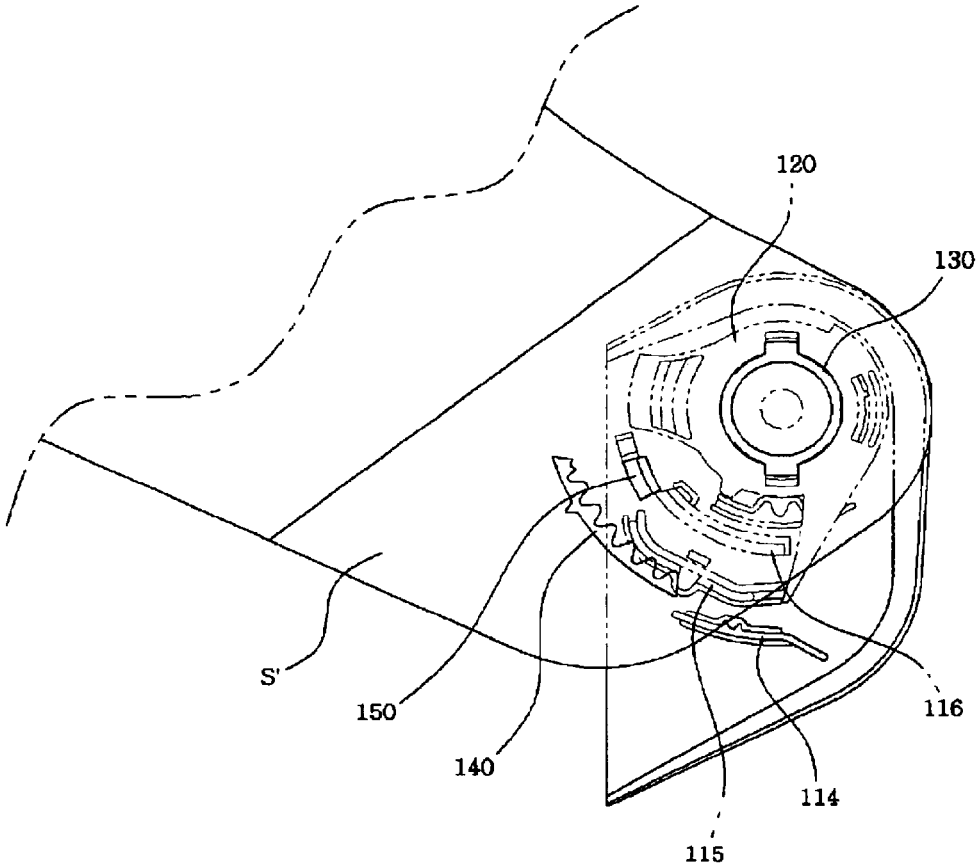

【Fig. 10】
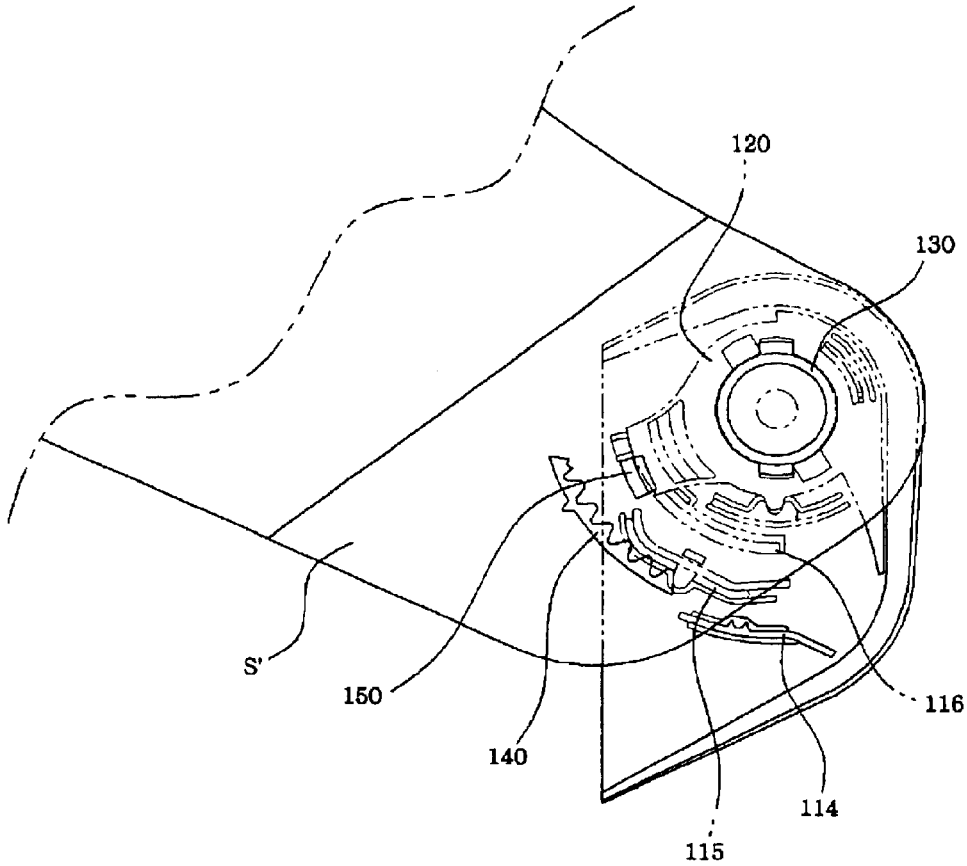

【Fig. 11】
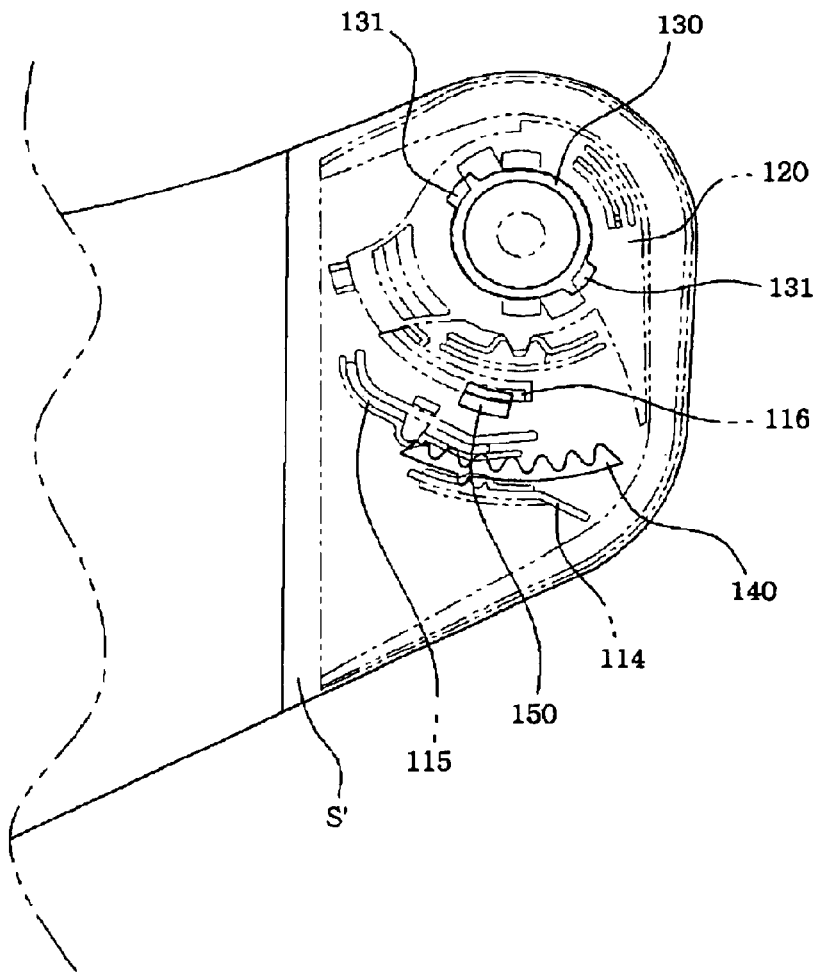

SHIELD MOUNTING DEVICE OF HELMET

BACKGROUND OF THE INVENTION

1. Field of the Invention

The present invention relates to a helmet worn to a user's head when a person rides a motorcycle, and in particular to a shield mounting device used when a shield adapted to protect a front side of a helmet user is assembled to a body of a helmet.

2. Description of the Background Art

In a motorcycle or a race vehicle, a rider and co-rider wear a protection gear such as a helmet for protecting their head from a certain accident.

As shown in FIG. 1, the helmet includes a body B having an opening O in a front side of the same in a structure that a head portion of a user is fully covered, and a front side of a user's face is exposed, and a shield S adapted to protect a user's face exposed through the opening of the body B from wind or a foreign substance and formed of a transparent material and assembled to the body B. In particular, the shield S is assembled to a portion (the hatched portion of FIG. 1) of both sides of the helmet by an assembling apparatus. In the assembling apparatus, the shield S assembled to the body B is rotated up and down, so that the opening O of the body B is opened or closed.

As an example of the conventional shield mounting device, according to the U.S. Pat. No. 6,260,213 (filing date: Nov. 15, 1999, and applicant: Hong Jin Crown Corporation), there is provided a shield connector. In the shield connector of Hong Jin Crown Corporation, a base plate includes a circular guide, and an insertion and guiding portion communicating with the guide and is fixed to a helmet body. A rotation member is rotatably inserted into the guide of the base plate. A connection member is formed in an inner surface of the shield and is inserted into the rotation member through the insertion guiding portion. In addition, a locker is rotatably installed along an outer surface of the guide and is adapted to lock the connection member inserted into the rotation member. The detailed constructions and operations of the shield connector of the Hong Jin Crown Corporation having the above described constructions are well described in the cited references. However, according to the shield assembly apparatus by the Hong Jin Crown corporation, in a state that the rotation member is inserted into the inner side of the guide of the base plate, and the locker is engaged to the outer surface of the guide, the connection member of the shield is slid in the inner direction of the rotation member through the insertion guiding portion of the base plate and is assembled. In the above state, the locker is rotated, and then the connection member is locked for thereby finishing the assembling procedure of the shield. In the conventional art, the assembling procedure is complicated and has inconvenience. Therefore, the productivity of the helmet is decreased. In addition, since the guide, the rotation member, the connection member, and the locker have tight assembling sizes, each assembling operation is easily performed, but it is very difficult to disassemble the assembled parts. Therefore, there are many problems for separating the shield from the helmet for the purpose of cleaning or exchange.

SUMMARY OF THE INVENTION

Accordingly, it is an object of the present invention to provide a shield mounting device of a helmet that overcomes the problems encountered in the conventional art.

It is another object of the present invention to provide a shield assembling device of a helmet capable of enhancing an assembling capacity of parts and a productivity of a helmet based on a part simplification and an improved assembling structure.

It is further another object of the present invention to provide a shield assembling apparatus of a helmet capable of easily disassembling a shield from a helmet for the purpose of cleaning or exchange by a user in such a manner that there is provided a structure in which parts are easily disassembled.

To achieve the above objects, there is provided a shield mounting device of a helmet which comprises a base plate having a guide with a circular rim wall and fixed to a body of a helmet; a connection member formed on an inner surface of the shield and engaged to an inner surface of the guide; a locker assembled to an outer surface of the rim wall of the guide and locking or unlocking the connection member engaged to the guide; an insertion groove formed in an inner side of the rim wall of the guide; a protrusion piece formed on an outer surface of the rim wall; and an engaging piece formed on an outer surface of the connection member and inserted into the insertion groove, wherein the locker includes a center hole into which the rim wall of the guide is inserted; a flange adapted to cover a part of an edge of the inner side of the center hole; an engaging piece through hole extended from the center hole to the flange wherein the engaging piece of the connection member masses through the engaging piece through hole; a first slot and a step part longitudinally formed at the same curvature as the rim wall of the guide wherein the protrusion piece is inserted and engaged to the first slot and step part; and a handle provided in such a manner that a user can easily rotate the locker.

In the base plate, a hook type protrusion is formed near a portion symmetrical with respect to the protrusion piece about a center of the guide, and a second slot and a step part are formed in the locker near a portion symmetrical with respect to the slot wherein the hook type protrusion is inserted and engaged to the second slot and the step part.

There is further provided a third slot longitudinally formed in an outer portion of the first slot of the locker at the same curvature as the first slot.

The insertion groove formed in an inner side of the rim wall of the guide is respectively provided in location of antisymmetrical side with respect to the center of the guide, and the engaging piece of the connection member and the engaging piece through hole of the locker are provided in the same number as the number of the insertion grooves and in the same shape as the insertion groove.

A rotation slit is formed in an edge of the inner side of the rim wall of the guide in such a manner that the engaging piece of the connection member inserted into the insertion groove is slidably rotated in the inner side of the rim wall.

A locker fixing piece elastically movable with respect to the rim wall of the guide and having a fixing groove is provided on the base plate, and a protrusion is provided on an outer surface of the locker and is inserted into the fixing groove of the locker fixing piece at a position for locking the connection member in order to fix the locker.

BRIEF DESCRIPTION OF THE DRAWINGS

The present invention will become better understood with reference to the accompanying drawings which are given only by way of illustration and thus are not limitative of the present invention, wherein;

FIG. 1 is a lateral view illustrating a helmet assembled with a shield;

FIG. 2 is a disassembled perspective view illustrating a base plate and a locker forming a base assembly as a part of a shield mounting device according to the present invention;

FIG. 3 is a bottom side perspective illustrating the locker of FIG. 2;

FIG. 4 is a disassembled perspective view illustrating a base assembly of FIG. 2 and a shield mounted on the base assembly;

FIG. 5 is a plane view illustrating the construction before a locking is performed after the base assembly of FIG. 4 and a shield are assembled;

FIG. 6 is a plane view illustrating the construction after a locking is performed from the construction of FIG. 5;

FIG. 7 is a disassembled perspective view illustrating a base plate and a locker forming a base assembly in a shield mounting device of the present invention having a shield rotation unit;

FIG. 8 is a disassembled perspective view illustrating the base assembly of FIG. 7 and a shield assembled to the base assembly;

FIG. 9 is a plane view illustrating the construction before a locking is performed after the base assembly of FIG. 8 and a shield are assembled;

FIG. 10 is a plane view illustrating the construction after a locking is performed from the construction of FIG. 9; and FIG. 11 is a plane view illustrating the construction that a shield is rotated from the state of FIG. 10.

DETAILED DESCRIPTION OF THE PREFERRED EMBODIMENTS

The preferred embodiments of the present invention will be described with reference to the accompanying drawings.

FIG. 2 is a disassembled perspective view illustrating a base plate and a locker forming a base assembly as a part of a shield mounting device according to the present invention, and FIG. 4 is a disassembled perspective view illustrating the base assembly of FIG. 2 and a shield assembled to the base assembly.

As shown therein, the shield mounting device according to the present invention includes a base assembly having a base plate 10 and a locker 20 and fixed to a body of a helmet, and a connection member 30 formed in an inner surface of the shield S and assembled to the base assembly. The detailed constructions are as follows.

First, the base plate 10 is a flat member directly fixed to the body of the helmet and has a guide 11 having a circular rim wall 11*a*. An insertion groove 11*b* is formed in an inner side of the rim wall 11*a* of the guide 11. The insertion groove 11*b* is respectively formed in the opposite sides of the center of the guide 11. One protrusion part 11*c* is formed on an outer surface of the rim wall 11*a*.

Next, the connection member 30 is a member engaged to the inner surface of the guide 11 for assembling a shield S to the base assembly. An engaging part 31 is provided on an outer surface of the connection member 30 and includes an engaging part 31 inserted into the insertion groove 11*b* of the guide 11. The engaging part 31 is provided in the same number as the number of the insertion grooves 11*b* in the portions corresponding to the portions in which the insertion groove 11*b* of the guide 11 is formed.

The locker 20 forming the base assembly together with the base plate 10 includes a circular center hole 20*a* into which the rim wall 11*a* of the guide 11 in the center of the same. The locker 20 assembled to the outer surface of the rim wall 11*a* of the guide 11 is rotated about the guide 11 as a center axis and locks or unlocks the connection member 30. In particular, as shown in FIG. 3, a flange 20*b* is formed in an edge of the center hole 20*a* in the direction of the center of the center hole 20*a* and covers a part of the edge of the inner side of the center hole 20*a*. In addition, a through hole 20*c* is extended in the direction from the center hole 20*a* to the flange 20*b* in order for the engaging part 31 of the connection member 30 to pass through. In the outer portion of the flange 20*a*, there are provided a slot (first slot 20*d*) longitudinally formed at the same curvature as the rim wall 11*a* of the guide 11 wherein the protrusion part 11*c* of the guide is inserted into the slot, and a step part 20*e* extended from the first slot 20*d* wherein the protrusion part 11*c* inserted into the first slot 20*d* is engaged to the step part 20*e*. In a state that the locker 20 is assembled to the guide 11, when the locker 20 is rotated in the locking or unlocking direction, the locker 20 is well rotated, not escaping from the guide 11 by the protrusion part 11*c* of the guide 11 inserted into the first slot 20*d* of the locker 20. A hook shaped protrusion 12 is provided on the base plate 10 near the portion symmetrical with respect to the protrusion part 11*a* with respect to the center of the guide 11 for a smooth rotation of the locker 20. There may be further provided a slot (second slot 20*f*) and a step part 20*g* near the portion symmetrical with respect to the first slot 20*d* about the center hole 20*a* as a center in the locker 20 wherein the hook shaped protrusion 12 is inserted and engaged to the second slot 20*f* and the step part 209, respectively. A third slot 20*h* may be further provided at the same curvature as the first slot 20*d* in the outer side of the first slot 20*d*. Therefore, when the locker 20 is assembled to the guide 11, and the protrusion part 11*c* of the guide 11 is pushed into the first slot 20*d*, the first slot 20*d* and the step part 20*e* are elastically deformed, so that the protrusion part 11*c* is smoothly inserted into the first slot 20*d* and the step part 20*e*, respectively. A locker fixing part 13 may be provided on the base plate 10 wherein it is elastically movable with respect to the rim wall 11*a* of the guide 11. The locker fixing part 13 includes a fixing groove 13*a*. A protrusion 20*i* is provided on the outer surface of the locker 20 and is inserted into the fixing groove 13*a* in the portion for locking the connection member 30 and fixes the locker 20. In addition, a handle 20*j* is provided on an outer surface of the locker 20 for easily moving the locker 20 to the locking position and the unlocking position.

FIG. 5 is a plane view illustrating the construction before a locking is performed after the base assembly of FIG. 4 and a shield are assembled, and FIG. 6 is a plane view illustrating the construction after a locking is performed from the construction of FIG. 5. First, as shown in FIG. 5, the locker 20 is assembled to the guide 11 of the base plate 10, and the connection member 30 of the shield S is set in the inner circumferential surface of the guide 11 through the center hole of the locker 20. In this state, since the through hole of the engaging part of the locker 20 fully opens the insertion groove of the guide 11, the engaging part 31 of the connection member 30 mounted in the insertion groove of the guide through the through hole of the engaging part of the locker 20 may be escaped from the insertion groove any time. The above state is the unlocking state. As shown in FIG. 6, in the above state, when the locker 20 is rotated in the to counterclockwise direction using the handle 20*j*, the flange. 20*b* of the locker 20 is positioned in the upper side of the engaging part 20*b*, so that the engaging part 31 is not escaped from the insertion groove of the guide 11. The above state is the locking state. In the above locking state, the protrusion 20*i* formed in the outer surface of the locker 20 is inserted into the fixing groove 13*a* of the locker fixing part 13 provided in the base plate 10, so that the locker 20 is not moved unnecessarily. Thereafter, the assembling of the shield with respect o the helmet is finished.

Next, FIGS. 7 and 8 are views of another embodiment of the present invention based on FIGS. 2 and 4. In this embodiment of the present invention, there is provided a shield rotation member besides a shield mounting device in the base plate and the shield.

In the base plate 110, there is the shield rotation member besides the shield mounting device comprising the guide 111, the locker 120 and the connection member. The shield rotation member provides a shield fixing part 114 having a fixing groove 114*a*, a shield angle adjusting part 115 having a fixing protrusion 115*a*, and a rotation guide part 116 adapted to guide the rotation of the shield S'.

A rack piece 140 is provided on an inner surface of the shield S'. A plurality of grooves 140*a* are provided on one side of the rack piece 140 wherein the fixing protrusion 115*a* of the shield angle adjusting part 115 is selectively inserted into the grooves 140*a*. A protrusion 140*b* a is provided on the other side of the rack piece 140 and is inserted into the fixing groove 114*a* of the shield fixing part 114. A slide piece 150 is provided near the rack piece 140 and is slid between the rotation guide parts 116.

In the shield mounting device according to the present invention having the shield rotation member, a rotation slit 111*d* is further provided at an edge of the inner side of the rim wall 111*a* of the guide 111. In a state that an engaging end 131 of the connection member 130 is inserted in the insertion groove 111*b* of the guide 111 (namely, the shield is assembled to the helmet by the shield mounting device in the former embodiment of the present invention), when the shield S' is rotated for adjusting the angle of the shield S', the rotation slit 111*d* provides a way so that the engaging end 131 is slidably rotated in the inner side of the rim wall 111*a* of the guide 111.

As shown in FIGS. 9 and 10, in the shield mounting device having the shield rotation member according to the present invention, the shield S' is assembled to the helmet by locking the connection member 130 according to the operation of the locker 120 in the same manner as the former embodiment of the present invention. As shown in FIG. 11, when rotating the shield S', the engaging end 131 formed in the connection member 130 of the shield S is slid through the rotation slit 111*d* of the guide 111, so that the shield S' is rotated together with the elements 114, 115, 116, 140 and 150 forming the shield rotation member.

As described above, in the shield mounting device of a helmet according to the present invention, the number of the parts is decreased as compared to the conventional art, and the assembling construction is simplified. Therefore, the assembling capability of each part and the productivity of the helmet are enhanced.

In addition, in the present invention, there is provided a structure in which each part is easily disassembled, so that the user of the helmet can easily disassemble the shield from the helmet at any time, whereby the cleaning and exchange of the shield are easily performed in the present invention.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A shield mounting device of a helmet, comprising:

a base plate having a guide with a circular rim wall and fixed to a body of a helmet;

a connection member formed on an inner surface of the shield and engaged to an inner surface of the guide;

a locker assembled to an outer surface of the rim wall of the guide and locking or unlocking the connection member engaged to the guide;

an insertion groove formed in an inner side of the rim wall of the guide;

a protrusion piece formed on an outer surface of the rim wall; and an engaging piece formed on an outer surface of the connection member and inserted into the insertion groove, wherein said locker includes:

a center hole into which the rim wall of the guide is inserted;

a flange adapted to cover a part of an edge of the inner side of the center hole;

an engaging piece through hole extended from the center hole to the flange wherein the engaging piece of the connection member passes through the engaging piece through hole;

a first slot and a step part longitudinally formed at the same curvature as the rim wall of the guide wherein the protrusion piece is inserted and engaged to the first slot and step part; and a handle provided in such a manner that a user can easily rotate the locker.

2. The device of claim 1, wherein in said base plate, a hook type protrusion is formed near a portion symmetrical with respect to the protrusion piece about a center of the guide, and a second slot and a step part are formed in the locker near a portion symmetrical with respect to the slot wherein the hook type protrusion is inserted and engaged to the second slot and the step part.

3. The device of claim 1, further comprising a third slot longitudinally formed in an outer portion of the first slot of the locker at the same curvature as the first slot.

4. The device of claim 1, wherein said insertion groove formed in an inner side of the rim wall of the guide is respectively provided in location of antisymmetrical side with respect to the center of the guide, and the engaging piece of the connection member and the engaging piece through hole of the locker are provided in the same number as the number of the insertion grooves and in the same shape as the insertion groove.

5. The device of claim 1, wherein a rotation slit is formed in an edge of the inner side of the rim wall of the guide in such a manner that the engaging piece of the connection member inserted into the insertion groove is slidably rotated in the inner side of the rim wall.

6. The device of claim 1, wherein a locker fixing piece elastically movable with respect to the rim wall of the guide and having a fixing groove is provided on the base plate, and a protrusion is provided on an outer surface of the locker and is inserted into the fixing grove of the locker fixing piece at a position for locking the connection member in order to fix the locker.

7. The device of claim 2, further comprising a third slot longitudinally formed in an outer portion of the first slot of the locker at the same curvature as the first slot.

8. The device of claim 4, wherein a rotation slit is formed in an edge of the inner side of the rim wall of the guide in such a manner that the engaging piece of the connection member inserted into the insertion groove is slidably rotated in the inner side of the rim wall.

* * * * *